United States Patent [19]

Battaglia

[11] Patent Number: 4,955,505

[45] Date of Patent: Sep. 11, 1990

[54] TRASH RECEPTACLE LINING SYSTEM

[76] Inventor: Michael A. Battaglia, 7609 W. Lake St., St. Louis Park, Minn. 55426

[21] Appl. No.: 370,179

[22] Filed: Jun. 23, 1989

[51] Int. Cl.[5] ..... B65D 25/16

[52] U.S. Cl. ..... 220/407; 220/470; 206/390; 206/397

[58] Field of Search ..... 220/407, 470; 206/390, 206/397, 395, 408

[56] References Cited

U.S. PATENT DOCUMENTS

| | | | |
|---|---|---|---|
| 303,670 | 8/1884 | Seavey | 220/70 |
| 488,758 | 12/1892 | Gates | 220/70 |
| 3,451,453 | 6/1969 | Heck . | |
| 3,701,522 | 10/1972 | Chi . | |
| 4,055,273 | 10/1977 | Jones | 220/70 |
| 4,264,017 | 4/1981 | Karas et al. | 220/70 |
| 4,319,694 | 3/1982 | Nehrbass et al. . | |
| 4,349,123 | 8/1982 | Yang . | |
| 4,721,226 | 1/1988 | Yurko . | |
| 4,798,363 | 1/1989 | Cortesi | 220/407 |
| 4,823,979 | 4/1989 | Clark, Jr. | 220/407 |

*Primary Examiner*—Joseph Man-Fu Moy

*Attorney, Agent, or Firm*—Jerry T. Kearns

[57] ABSTRACT

A trash receptacle lining system utilizes a roll of perforated plastic trash bags mounted for rotation on a transverse spindle. In a first embodiment, the spindle may be provided on an originally constructed trash receptacle having open top and bottom ends separated by a transverse slotted partition. The spindle mounts the trash bag roll below the partition and the free end of the trash bag roll is received through the slotted partition into the upper portion of the receptacle. This allows a new trash bag liner to be conveniently installed upon removal of a filled trash bag. A foot pedal actuated braking mechanism may be provided to secure the trash bag roll against rotation during separation of the perforated trash bags. In a second embodiment, the trash bag roll is mounted for rotation on a transversely extending spindle within a trapezoidal housing. The housing has a widest bottom end dimensioned for insertion within a conventional open top-closed bottom trash receptacle. A weighted base of the housing retains the housing securely within the bottom portion of the conventional receptacle.

5 Claims, 4 Drawing Sheets

TRASH RECEPTACLE LINING SYSTEM

BACKGROUND OF THE INVENTION

1. Field of the Invention

The present invention relates to trash receptacle lining systems, and more particularly pertains to an improved trash receptacle lining system which utilizes a roll of trash bags separated by perforated tear zones. Utilizing conventional trash receptacles, an individual must remove a filled trash bag and subsequently manually install a new bag within the receptacle. This forces the individual to bend over and to have manual contact with the frequently soiled interior of the trash receptacle. In order to overcome this problem, the present invention provides a trash receptacle lining system in which a new trash bag is automatically moved into an operative position upon removal of a filled bag.

2. Description of the Prior Art

Various types of trash receptacle lining systems are known in the prior art. A typical example of such a lining system is to be found in U.S. Pat. No. 3,451,453, which issued to E. Heck on June 24, 1969. This patent discloses a waste receptacle having an inserted trash bag dispenser. U.S. Pat. No. 3,701,522, which issued to T. Chi on Oct. 31, 1972, discloses a method of folding sheet material for serial extraction from dispensers. U.S. Pat. No. 4,319,694, which issued to J. Nehrbass et al on Mar. 16, 1982, discloses a trash receptacle having open top and bottom ends separated by a transverse partition and including a concave transverse well adapted to receive a roll of trash bag liners. U.S. Pat. No. 4,349,123, which issued to Y. Yang on Sept. 14, 1982, discloses a trash receptacle utilizing an inserted trash bag dispenser. U.S. Pat. No. 4,721,226, which issued to E. Yurko on Jan. 26, 1988, discloses a trash receptacle having a lateral insertion slot for a trash bag dispensing box.

While the above mentioned devices are directed to trash receptacle lining systems, none of these devices disclose a trash receptacle having open top and bottom ends separated by a slotted transverse partition and having a roll of perforated trash bags rotatably mounted on a transverse spindle within a trapezoidal bottom portion. Additional features of the present invention, not contemplated by the aforesaid prior art devices include the provision of a trapezoidal housing having an open bottom portion removably covered by a weighted base to allow installation of a new roll of trash bags when an existing roll is depleted, and the provision of a foot pedal actuated braking mechanism to secure the trash bag roll against rotation when the bag is being removed. Inasmuch as the art is relatively crowded with respect to these various types of trash receptacle lining systems, it can be appreciated that there is a continuing need for and interest in improvements to such trash receptacle lining systems, and in this respect, the present invention addresses this need and interest.

SUMMARY OF THE INVENTION

In view of the foregoing disadvantages inherent in the known types of trash receptacle lining systems now present in the prior art, the present invention provides an improved trash receptacle lining system. As such, the general purpose of the present invention, which will be described subsequently in greater detail, is to provide a new and improved trash receptacle lining system which has all the advantages of the prior art trash receptacle lining systems and none of the disadvantages.

To attain this, representative embodiments of the concepts of the present invention are illustrated in the drawings and make use of a trash receptacle lining system which utilizes a roll of perforated plastic trash bags mounted for rotation on a transverse spindle. In a first embodiment, the spindle may be provided on an originally constructed trash receptacle having open top and bottom ends separated by a transverse slotted partition. The spindle mounts the trash bag roll below the partition and the free end of the trash bag roll is received through the slotted partition into the upper portion of the receptacle. This allows a new trash bag liner to be conveniently installed upon removal of a filled trash bag. A foot pedal actuated braking mechanism may be provided to secure the trash bag roll against rotation during separation of the perforated trash bags. In a second embodiment, the trash bag roll is mounted for rotation on a transversely extending spindle within a trapezoidal housing. The housing has a widest bottom end dimensioned for insertion within a conventional open top closed bottom trash receptacle. A weighted base of the housing retains the housing securely within the bottom portion of the conventional receptacle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash receptacle lining system which has all the advantages of the prior art trash receptacle lining systems and none of the disadvantages.

It is another object of the present invention to provide a new and improved trash receptacle lining system which may be easily and efficiently manufactured and marketed.

It is a further object of the present invention to provide a new and improved trash receptacle lining system which is of a durable and reliable construction.

An even further object of the present invention is to provide a new and improved trash receptacle lining system which is susceptible of a low cost of manufacture with regard to both materials and labor, and which accordingly is then susceptible of low prices of sale to the consuming public, thereby making such trash receptacle lining systems economically available to the buying public.

Still yet another object of the present invention is to provide a new and improved trash receptacle lining system which provides in the apparatuses and methods of the prior art some of the advantages thereof, while simultaneously overcoming some of the disadvantages normally associated therewith.

Still another object of the present invention is to provide a new and improved trash receptacle lining system which allow individuals to install a new trash bag liner within a receptacle without bending over or soiling their hands.

Yet another object of the present invention is to provide a new and improved trash receptacle lining system which may be retrofitted into conventional trash receptacles.

Even still another object of the present invention is to provide a new and improved trash receptacle lining system which allows serial usage of perforated trash bags supplied on a continuous roll.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
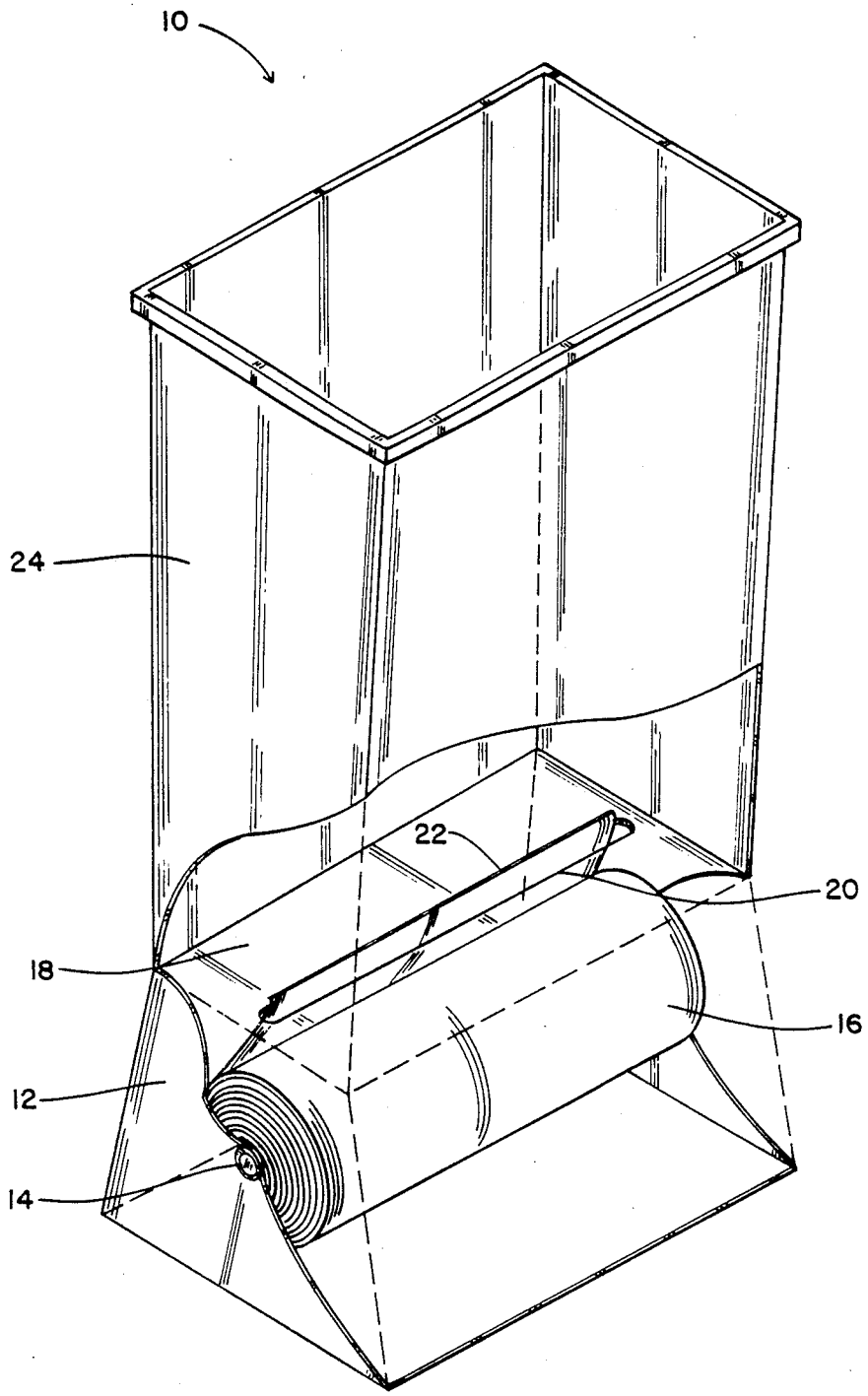
FIG. 1 is a perspective view of a trash receptacle lining system according to a first embodiment of the present invention.

With reference now to the drawings, and in particular to FIG. 1 thereof, a new and improved trash receptacle lining system embodying the principles and concepts of the present invention and generally designated by the reference numeral 10 will be described.

More specifically, it will be noted that the first embodiment 10 of the invention includes a receptacle having open top and bottom ends separated by a transverse partition 18 having a slot 20 formed therethrough. The bottom portion of the receptacle 12 between the partition 18 and the open bottom end has a trapezoidal configuration to provide a stable supporting surface. A spindle 14, which may be stationarily or rotationally mounted, receives a roll 16 formed from a continuous length of trash bags separated by perforated zones. The free end portion 22 of the trash bag roll 16 is inserted through the slot 20 in the partition 18. It should be understood that the perforated zones on the roll 16 are formed in a manner such that the free end 22 will allow the bag to be freely opened in a conventional fashion. The spindle 14 is removably mounted within the bottom end 12 such that a new roll 16 may be installed through the open bottom end of the receptacle when the existing roll is depleted. The spindle 14 may comprise a rigid cylindrical rod having opposite ends received in corresponding sockets formed in a trapezoidal bottom portion 12. The bottom portion 12 will then be formed of a slightly flexible material allowing the side wall portions to be slightly expanded to allow removal of the ends of the spindle 14 from the corresponding sockets. Alternatively, the spindle 14 may be formed from spring biased telescoping sections in the conventional fashion of a toilet tissue dispenser spindle. In either case, the spindle 14 provides a rotational mounting for the trash bag roll 16. After an existing bag is filled, it will then be closed, tied shut and pulled upwardly from the top portion 24 of the receptacle, simultaneously causing the next serial trash bag to be moved into an operative position. The bags are manually separated at the perforation zone and the trash receptacle is again ready for usage.

Figure 2:
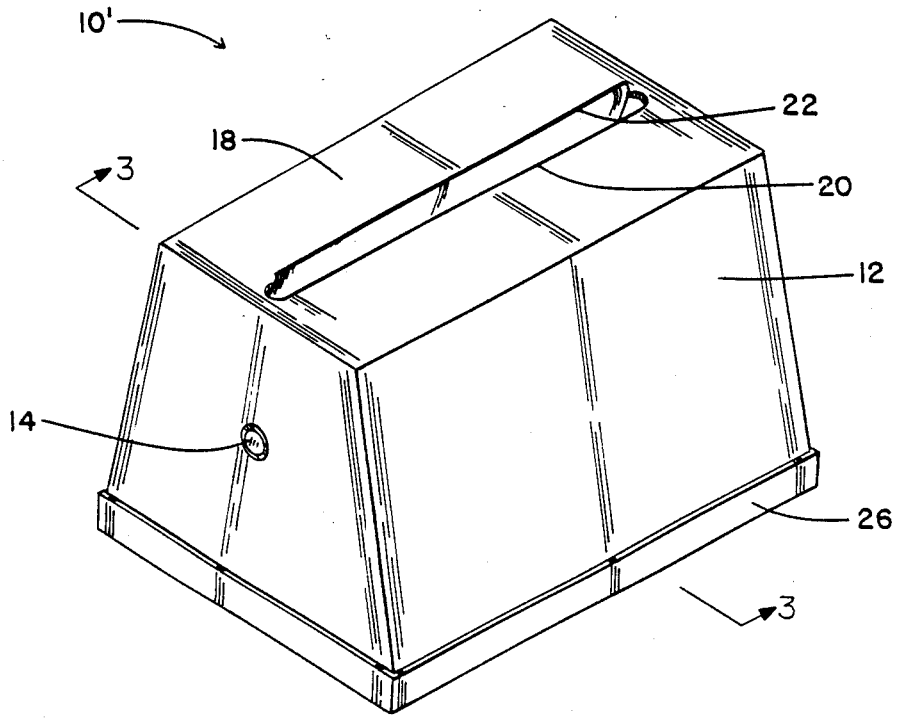
FIG. 2 is a perspective view illustrating a trash receptacle lining system according to a second embodiment of the present invention.

FIG. 2 is a perspective view which illustrates a trash receptacle lining system 10' according to a second embodiment of the present invention which may be retrofitted into a conventional trash receptacle. The device includes a generally trapezoidal housing 12 having a transverse top wall 18 provided with a slot 20 through which the free end 22 of a roll of interconnected trash bags extends. The trash bag roll is mounted for rotation on a spindle 14 which extends transversely across the trapezoidal housing 12. The bottom widest end of the housing 12 is open, and is removably covered by a base 26.

Figure 3:
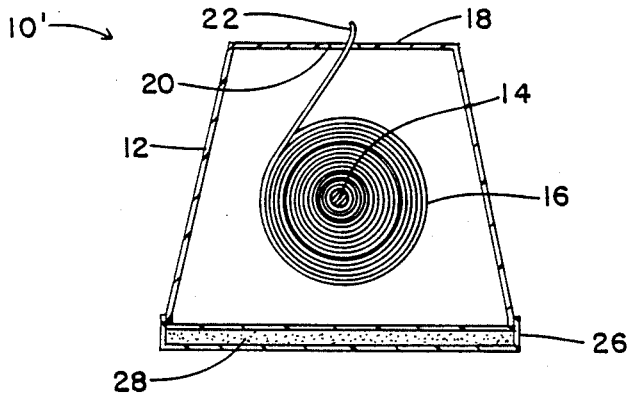
FIG. 3 is a transverse cross sectional view, taken along line 3—3 of FIG. 2.

As shown in the cross sectional view of FIG. 3, the base 26 is filled with a dense particulate material 28 such as lead shot, cement or sand. This provides a sufficient weight to securely retain the housing 12 within the bottom portion of a conventional trash receptacle. Additionally, the housing 12 and base 26 are suitably dimensioned such that frictional engagement between the base 26 and the side walls of the trash receptacle further assists in retaining the housing 12 therein. It should be understood that the housing 12 may be formed in a variety of sizes for use with various different conventional sizes of trash receptacles.

Figure 4:
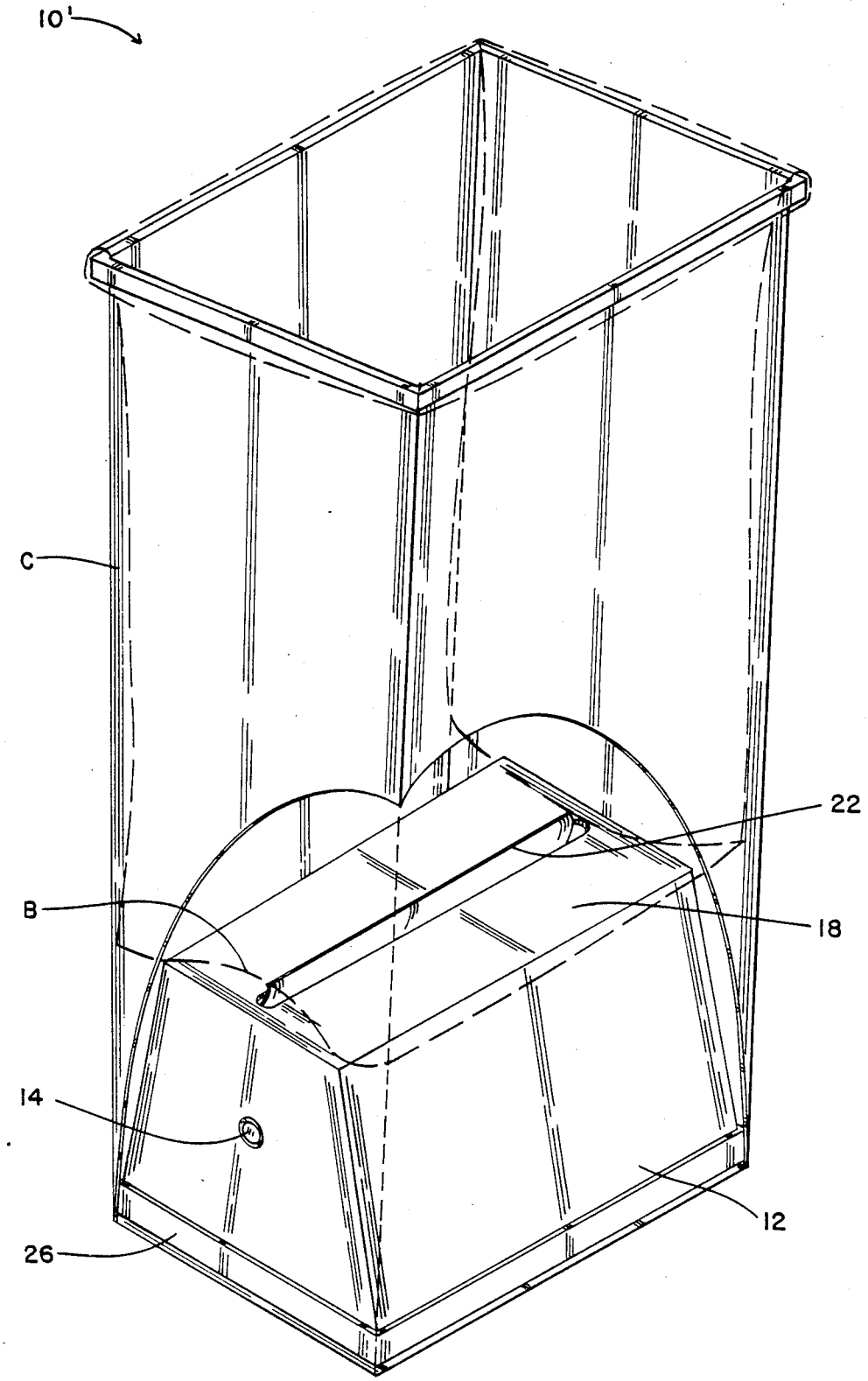
FIG. 4 is a perspective view, partially cut away, illustrating the trash receptacle lining system of FIG. 2 retrofitted in a conventional trash receptacle.

FIG. 4 is a perspective view, partially cut away, which illustrates the trash receptacle lining system 10' installed within a conventional trash can C. The outer uppermost bag B is illustrated in phantom line in an installed condition. The upper end 22 of the trash bag roll within the housing 12 is connected by a perforation with the closed bottom portion of the installed bag B and will be pulled to an operative position upon removal of the bag B. The weighted base 26 frictionally engages the side walls of the trash can C, firmly retaining the housing 12 therein. The trapezoidal shape of the housing 12 causes the side walls to be tapered inwardly, allowing relatively free insertion into the can C.

Figure 5:
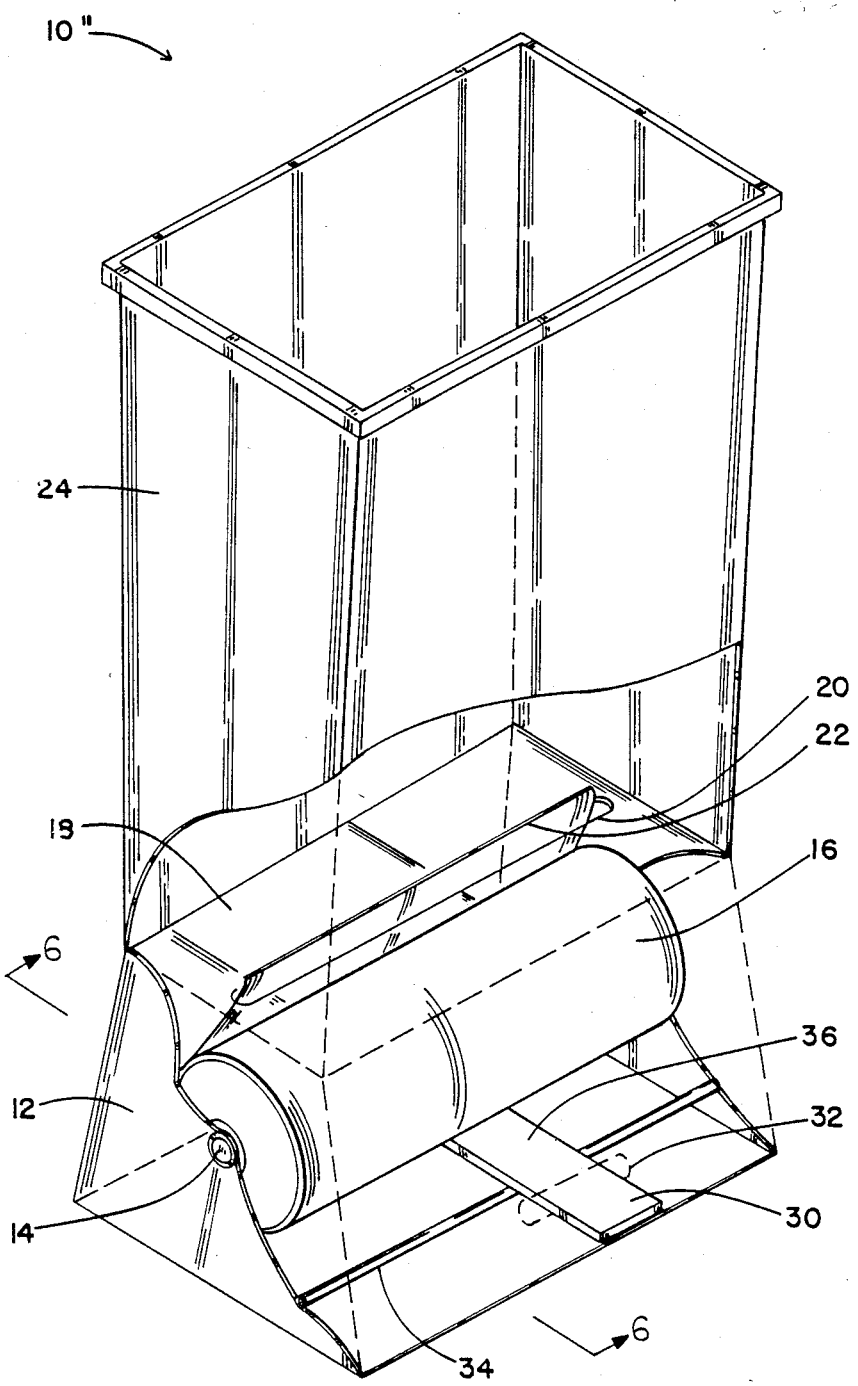
FIG. 5 is a perspective view, partially cut away, illustrating a trash receptacle lining system similar to FIG. 1, with the addition of a trash bag roll foot pedal actuated braking mechanism.

FIG. 5 illustrates a third embodiment 10', similar to the trash receptacle lining system illustrated in FIG. 1, with the exception that a foot pedal actuated braking mechanism is provided to selectively retain the trash bag roll 16 against rotation when the uppermost bag is being separated from the next serial bag along a perforation zone. This prevents several bags from being inadvertently uncoiled from the roll 16 when a filled bag is removed. The braking mechanism includes a foot pedal 30 having an inner end 36 movable into and out of frictional engagement with the roll 16 The foot pedal 30 is pivotally mounted on a spindle 34 at an intermediate portion and has an outer end extending outwardly through the side wall of the bottom portion 12 through a slot 32. This allows an individual to conveniently restrain the roll 16 during the separation of a filled bag from a next adjacent bag.

Figure 6:
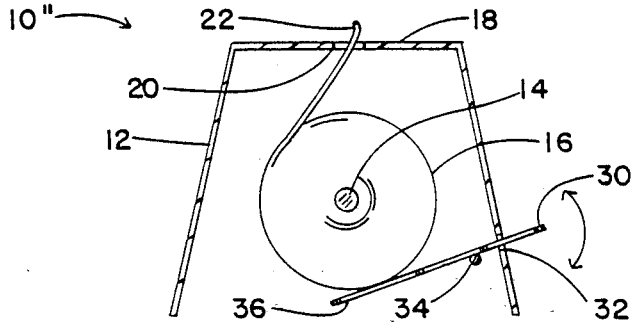
FIG. 6 is a partial transverse cross sectional view, taken along line 6—6 of FIG. 5.

FIG. 6 is a partial cross sectional view which further illustrates the details of the foot pedal actuated braking mechanism. It should be noted that the construction of the mechanism allows the pedal 30 to return to a disengaged position by virtue of gravity alone.

As will now be understood, the present invention provides a trash receptacle lining system which may be originally formed as an integral part of a trash receptacle, or adapted for installation into existing conventional trash receptacles. In either case, the present invention provides a trash receptacle lining system which allows individuals to rapidly and conveniently install a trash bag liner into a trash receptacle without bending over or coming into manual contact with a potentially contaminated trash receptacle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A trash receptacle lining system, comprising:
a receptacle having open top and bottom ends separated by an intermediate transverse partition;
a slot formed through said partition;
a spindle mounted transversely within said receptacle, between said partition and said bottom end;
a roll of perforated trash bags mounted for rotation on said spindle; and
brake means for selectively securing said roll against rotation.

2. The trash receptacle lining system of claim 1, wherein said brake means comprises a foot pedal actuated braking mechanism.

3. A trash receptacle lining system, comprising:
a receptacle having an open top end and a closed bottom end;
a housing dimensioned for insertion into said receptacle;
said housing having a slotted top wall;
a spindle mounted transversely within said housing;
a roll of perforated trash bags mounted for rotation on said spindle; and
said housing having an open bottom end removably covered by a weighted base to allow installation of a new roll of trash bags upon depletion of an existing roll.

4. The trash receptacle lining system of claim 3, wherein said housing is of a trapezoidal shape having a widest bottom end dimensioned for frictional engagement within said receptacle.

5. A trash receptacle lining system, comprising:
a receptacle having an open top end and a closed bottom end;
a housing dimensioned for insertion into said receptacle;
said housing having a trapezoidal shape with a widest bottom end dimensioned for frictional engagement within said receptacle;
said housing having a slotted top wall;
a spindle mounted transversely within said housing; and
a roll of perforated trash bags mounted for rotation on said spindle.

* * * * *